United States Patent [19]

Tanaka et al.

[11] 4,047,897

[45] Sept. 13, 1977

[54] SINTERED ALLOY FOR CUTTING TOOLS

[75] Inventors: Hiroshi Tanaka; Osamu Kato, both of Nagoya, Japan

[73] Assignee: NGK Spark Plug Co., Ltd., Nagoya, Japan

[21] Appl. No.: 731,959

[22] Filed: Oct. 13, 1976

[30] Foreign Application Priority Data

Oct. 14, 1975 Japan ..... 50-123561

[51] Int. Cl.[2] ..... C22C 29/00

[52] U.S. Cl. ..... 428/539.5

[58] Field of Search ..... 29/182.5, 182.8, 182.7; 75/203, 204, 205

[56] References Cited

U.S. PATENT DOCUMENTS

| | | | |
|---|---|---|---|
| 3,492,101 | 1/1970 | Prill et al. | 29/182.7 |
| 3,679,442 | 7/1972 | Bergna | 29/182.7 |
| 3,741,733 | 6/1973 | Kieffer | 29/182.7 |
| 3,840,367 | 10/1974 | Rudy | 29/182.7 |
| 3,994,692 | 11/1976 | Rudy | 72/205 |
| 3,999,954 | 12/1976 | Kolaska et al. | 29/182.7 |

*Primary Examiner*—Brooks H. Hunt

*Attorney, Agent, or Firm*—Sughrue, Rothwell, Mion, Zinn and Macpeak

[57] ABSTRACT

A sintered alloy for cutting tools comprising 60 to 90% by weight of a carbide comprising $Mo_2C$, WC and TiC in the proportions shown by the tetragonal region surrounded by points A, B, C and D in the ternary composition diagram of FIG. 1, the proportion of the sum of WC and $Mo_2C$ with a WC/$Mo_2C$ weight ratio of 35:65 to 65:35 being 50 to 75% by weight, and the proportion of TiC being 25 to 50% by weight, 3 to 20% by weight of a nitride selected from the group consisting of TiN, TaN or a mixture of TiN and TaN, and 5 to 20% by weight of Ni, Co or a mixture of Ni and Co as a binder metal, and further comprising a solid solution phase of the carbide and nitride with a grain size of not more than 1.3 $\mu$ and a binder metal phase.

1 Claim, 3 Drawing Figures

SINTERED ALLOY FOR CUTTING TOOLS

BACKGROUND OF THE INVENTION

1. Field of the Invention

This invention relates to a sintered alloy, e.g., for cutting tools, with advantageous properties.

2. Description of the Prior Art

WC-type hard metals and TiC-type cermets are available as sintered alloys for cutting tools which are used for turning, milling, etc. WC-type hard metals have superior thermal conduction and high toughness, but because of great crater wear, suffer from the defect that the edge of a cutting tool made of it tends to be damaged. Accordingly, the application of these metals to high speed cutting in current use is limited within a narrow range.

On the other hand, TiC-type cermets are suitable for high speed cutting because of their high hardness and superior thermal resistance. However, since they have low toughness and thermal shock resistance and tend to undergo plastic deformation at high temperatures, they suffer from the defect that chipping occurs in milling, intermittent cutting, etc., and when heavy cutting is performed, or when the workpiece has a high hardness, the cutting edge will be deformed and the life of the tool shortened.

Both of these types of alloys have therefore had only limited applications even in view of their advantages because of their disadvantages at the same time.

Attempts have been made to increase the toughness of TiC-type cermets by replacing not more than 50% by weight of the TiC as their main ingredient by another carbide such as WC, TaC or HfC. But these modifications only have made possible intermittent cutting of a small degree, and satisfactory alloys cannot be obtained.

TiC-type cermets resulting from the replacement of a part of the TiC by a metal nitride such as TiN or ZrN are also known. In this case, the cermets have improved shock resistance, and are effective in milling, and wet-type cutting involving thermal shock. However, since such a metal nitride has low hardness and tends to cause plastic deformation, such cermets have been directed to limited applications in which the cutting edge is maintained at low temperatures.

In the present invention a sintered alloy has been developed which comprises a TiC-type cermet for cutting tools, which obviates the defects of the WC-type hard metals and TiC-type cermets. Such can be applied to a wide range of use, particularly has enhanced resistance to plastic deformation without reducing the superior crater resistance of TiC-type cermets thus making possible heavy cutting at high speeds, further has improved thermal conduction and higher thermal shock resistance and mechanical shock resistance than TiC-type cermets resulting from replacing a part of TiC by another carbide or nitride, and is suitable for milling and wet-type cutting at high speeds.

A TiC-type cermet is composed basically of TiC, Ni and Mo. Mo, used conjointly with $Mo_2C$ or replaced by $Mo_2C$ diffuses into the surface of TiC due to its very high wettability thereby increasing the bond strength between the TiC and Ni. When the amount of Mo is excessive, a brittle intermediate phase [(Ti, Mo)C] is formed reducing the strength of the alloy. It has therefore been believed that the amount of Mo and/or $Mo_2C$ must be limited to not more than 20% by weight.

Repeated experiments on TiC-type cermets using various metal carbides, have now been conducted and consequently it has been found that by adding Ni and Co as binder metals to a ternary composition of TiC-WC-$Mo_2C$ in proportions shown by the range surrounded by A, B, C and D in FIG. 1, and forming and sintering the mixture, an alloy can be obtained which has markedly improved resistance to plastic deformation, enhanced thermal conduction and greatly improved thermal shock resistance. However, grain growth tends to occur in this alloy, and therefore the alloy has low mechanical shock resistance and unsatisfactory abrasion resistance.

In order to inhibit the grain growth which is the defect of the above alloy, repeated experiments were conducted, and satisfactory results have finally been obtained by incorporating 5 to 20% by weight of a nitride selected from TiN and/or TaN together with 5 to 20% by weight of a binder composed of Ni and/or Co.

SUMMARY OF THE INVENTION

Thus, the invention provides a sintered alloy for cutting tools which has a microcrystalline grain size (e.g., about 1.3 $\mu$ or less) and superior thermal shock resistance, mechanical shock resistance, abrasion resistance and resistance to plastic deformation not attainable heretofore and is suitable for milling and wet cutting at high speeds, the alloy comprising 60 to 92% by weight of a carbide composed of $Mo_2C$, WC and TiC in proportions shown by the tetragonal region A, B, C and D in the ternary composition diagram of FIG. 1, the proportion of the sum of the WC and $Mo_2C$ with a WC/$Mo_2C$ weight ratio of 35:65 to 65:35 being 50 to 75% by weight, and the proportion of TiC being 25 to 50% by weight, 3 to 20% by weight of a nitride which is either TiN or TaN, or a mixture of TiN and TaN, and 5 to 20% by weight of Ni or Co or a mixture of Ni and Co as a binder metal, and that it is made up of a solid solution phase of the carbide and nitride with a grain size of not more than 1.3 $\mu$ and a binder metal phase.

DETAILED DESCRIPTION OF THE INVENTION

Figure 1:
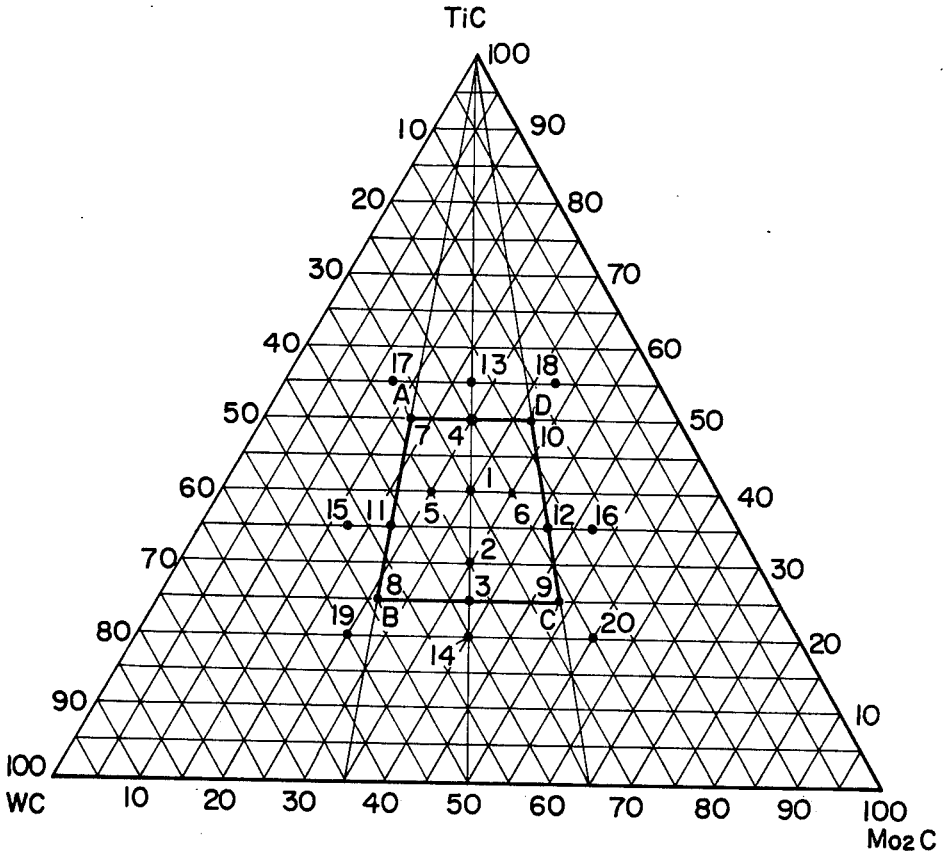
FIG. 1 is a ternary composition diagram of TiC, WC and $Mo_2C$ as main ingredients of the sintered alloy of this invention.

The invention is further described by the following Examples which are to be construed as merely exemplary and not limiting. Unless otherwise indicated herein, all parts, percents, ratios and the like are by weight.

EXAMPLE 1

Commercially available $Mo_2C$, WC, TiC, TiN, TaN, Ni and Co, all of which had a particle size of 1 to 2 $\mu$, were blended so that the final product would contain these components in the proportions indicated in Table 1 below, and pulverized in the wet state for 100 hours using a stainless steel ball mill and hard metal balls. The resulting mixed powder having a grain size of 0.5 to 0.8 $\mu$ was dried, and 3% of paraffin was added. The mixture was press-formed at a pressure of 1 t/cm$^2$, calcined at 800° C in a non-oxidizing atmosphere to volatilize off the binder, and pre-worked with a diamond dresser. Each of the samples obtained was heated to the sintering temperature. The cutting tool chips were precisely polished with a diamond wheel (No. 150) to test pieces of the size of SNP 432 (12.1 × 12.1 × 4.8 mm) and the size (4 × 8 × 25 mm) for determining deflective strength as set forth in JIS. The various properties of the test pieces were measured, and the results obtained are also shown in Table 1 below.

TABLE 1

| Sample No. | Carbide: $MO_2C$ | Carbide: WC | TiC 25–50 | Carbide in the Entire Composition 60–92 | Nitride: TiN | Nitride: TaN | Nitride: Total 3–30 | Binder Metal: Ni | Binder Metal: Co | Binder Metal: Total 5–20 | Sintering Temperature (° C) | Grain Size of Hard Plastic (μ) | Characteristic Value: Deflective Strength (kg/cm²) | Characteristic Value: Hardness (HRA) | Cutting Characteristics: (1) Amount of Plastic Deformation | Cutting Characteristics: (2) $V_B$ | Cutting Characteristics: (3) Damage Life (number) | Remarks |
|---|---|---|---|---|---|---|---|---|---|---|---|---|---|---|---|---|---|---|
| | $MO_2C/WC$ = 35:65–65:35; $WC+MO_2C$ = 50–75 | | | | | | | | | | | | | | | | | |
| 1 | 30 | 30 | 40 | 85 | 8 | — | 8 | 7 | — | 7 | 1.00 | 1.1–1.3 | 140 | 92.1 | 0.04 | 0.07 | more than 15 | |
| 2 | 35 | 35 | 30 | " | " | — | " | " | — | " | " | " | 142 | 92.1 | 0.04 | 0.07 | " | |
| 3 | 37.5 | 37.5 | 25 | " | " | — | " | " | — | " | " | " | 143 | 92.0 | 0.06 | 0.09 | " | |
| 4 | 25 | 25 | 50 | " | " | — | " | " | — | " | " | " | 140 | 92.1 | 0.05 | 0.07 | " | |
| 5 | 25 | 35 | 40 | " | " | — | " | " | — | " | " | " | 142 | 92.0 | 0.04 | 0.07 | " | |
| 6 | 35 | 25 | 40 | " | " | — | " | " | — | " | " | " | 140 | 92.2 | 0.05 | 0.07 | " | |
| 7 | 17.5 | 32.5 | 50 | " | " | — | " | " | — | " | " | " | 141 | 92.0 | 0.05 | 0.09 | | point A FIG. 1 |
| 8 | 26.2 | 48.8 | 25 | " | " | — | " | " | — | " | " | " | 149 | 92.0 | 0.05 | 0.09 | 15 | point B FIG. 1 |
| 9 | 48.8 | 26.2 | 25 | " | " | — | " | " | — | " | " | " | 136 | 92.1 | 0.05 | 0.08 | " | |
| 10 | 32.5 | 17.5 | 50 | " | " | — | " | " | — | " | " | " | 138 | 92.3 | 0.06 | 0.08 | more than 15 | point D FIG. 1 |
| 11 | 22.5 | 42.5 | 35 | " | " | — | " | " | — | " | " | " | 140 | 92.0 | 0.05 | 0.09 | " | |
| 12 | 42.5 | 22.5 | 35 | " | " | — | " | " | — | " | " | " | 137 | 92.2 | 0.06 | 0.08 | " | |
| 13 | 22.5 | 22.5 | 55 | " | " | — | " | " | — | " | " | " | 122 | 91.3 | 0.06 | 0.21 | 3 | outside the range A, B, C, D |
| 14 | 40 | 40 | 20 | " | " | — | " | " | — | " | " | " | 140 | 90.0 | chipping | chipping | 1 | |
| 15 | 17.5 | 47.5 | 35 | " | " | — | " | " | — | " | " | " | 79 | 89.2 | " | " | " | |
| 16 | 47.5 | 17.5 | 35 | " | " | — | " | " | — | " | " | " | 81 | 90.1 | " | " | " | |
| 17 | 12.5 | 32.5 | 55 | " | " | — | " | " | — | " | " | " | 101 | 90.0 | 0.12 | " | " | |
| 18 | 32.5 | 12.5 | 55 | " | " | — | " | " | — | " | " | " | 92 | 90.7 | 0.16 | " | " | |
| 19 | 25 | 55 | 20 | " | " | — | " | " | — | " | " | " | 78 | 88.2 | chipping | " | 2 | |
| 20 | 55 | 25 | 20 | " | " | | " | " | — | " | " | " | 83 | 89.3 | " | " | 3 | " |
| 1a | 30 | 30 | 40 | " | — | 8 | " | " | — | " | " | " | 135 | 92.4 | 0.03 | 0.08 | more than 15 | |
| 1b | " | " | " | " | 4 | 4 | " | " | — | " | " | " | 139 | 92.4 | 0.04 | 0.08 | " | |
| 1c | " | " | " | " | 8 | — | " | — | 7 | " | " | " | 142 | 92.2 | 0.04 | 0.07 | " | |
| 1d | " | " | " | " | " | — | " | 4 | 3 | " | " | " | 150 | 92.1 | 0.03 | 0.07 | " | |
| 1e | " | " | " | " | 4 | 4 | " | 4 | 3 | " | " | " | 155 | 92.1 | 0.02 | 0.07 | " | |
| Commercial grade | | | | | | | | | | | | | | | | | | |
| A | (TaC) 24.2 | 66.7 | 9.1 | 91 | — | — | — | — | 9 | 9 | | 2.2 | 166 | 91.5 | 0.06 | 0.37 | " | for comparison |
| B | — | — | 100 (75) | 75 | — | — | — | 15 | (Mo) 10 | 25 | | 3.0 | 119 | 91.8 | chipping | chipping | 2 | " |
| C | — | 26.6 | 73.4 | " | — | — | — | " | " | 25 | | 4.2 | 140 | 91.9 | 0.28 | " | 5 | " |
| D | (TaC) 20 | 26.6 | 53.4 | " | 10 | — | 10 | 10 | (Mo) 5 | 15 | | 3.3 | 121 | 91 0 | 0.31 | " | 7 | " |

Note

Cutting Characteristic 1

An $SCM_4$Ⓗ($H_B$(Brenell hardness) = 350) (JIS G 4105) rod workpiece was cut at a cutting speed of 110 m/min. with a cut depth of 1.0 mm and a feed of 0.31 mm/rev. for 10 minutes, and then the amount of the cutting edge deformed was determined.

Cutting Characteristic 2

Ten $SCM_4$Ⓗ($H_B$=350) (120 $\phi \times 30l$) workpieces were cut at a cutting speed of 120 m/min. with a cut depth of 2.0 mm and a feed of 0.5 mm/rev., and then the $V_B$ value of the cut workpieces was determined.

Cutting Characteristic 3

S55C ($H_B$=330) (JIS G 4051) blocks having an area of 100 × 100 mm were cut with a milling cutter with one cutting blade at a cutting speed of 177 m/min. with a cut depth of 2.0 mm and a feed of 0.3 mm/tooth, and the number of blocks cut until the cutter was damaged was determined.

In this Example, TiN and Ni were selected as the nitrile and the binder metal, respectively, and their proportions were set at 8% by weight and 7% by weight which were values at the centers of the specified ranges. In the remaining 85% by weight carbide, the proportions of WC, $Mo_2C$ were varied. The characteristics of the resulting sintered alloys were determined. It can be seen from the results in Table 1 that Samples Nos. 1 to 12 which were within the tetragonal region A, B, C and D in FIG. 1 (including the line definng this region) showed far superior deflective strength, hardness and cutting characteristics to Samples Nos. 13 to 20 which were outside the above tetragonal region.

Samples Nos. 1*a* to 1*e* which were obtained by fixing the ratio of $Mo_2C$, WC and TiC at 30:30:40 which is about at the center of the tetragonal region, and the amounts of the nitride and binder metal at the same values as above, and replacing all or one half of the nitride TiN by TaN and all or about one half of the binder metal Ni by Co exhibited characteristics comparable to Sample No. 1. In particular, it was confirmed that the conjoint use of Ni and Co as the binder metal can markedly increase the deflective strength of the resulting alloy as can be seen in Samples Nos. 1*d* and 1*e*.

EXAMPLE 2

In a carbide composed of three components, the ratio of WC + $Mo_2C$/TiC was set at 60:40 which was, just as in Sample No. 1, approximately at the center of the tetragonal region A, B, C and D. The amount of the carbide was set at 85%, and 8% of TiN as a nitride and 7% of Ni as a binder metal were used. Furthermore, the ratio of WC/$Mo_2C$ of 60% of the carbide was set and outside the range of 35:65 to 65:35. Under these conditions, samples were produced in the same manner as set forth previously. The various properties of the samples were determined, and the results obtained are shown in Table 2 below.

TABLE 2

| Sample No. | Carbide: $Mo_2C$ $Mo_2C/WC$ =35:65–65:35 WC+$Mo_2C$=50–75 | Carbide: WC | Carbide: TiC 25–50 | Carbide in the Entire Composition 60–92 | Nitride: TiN | Nitride: TaN | Nitride: Total 3–20 | Binder Metal: Ni | Binder Metal: Co | Binder Metal: Total 5–20 | Sintering Temperature (°C) | Characteristic Value: Deflective Strength (kg/cm²) | Characteristic Value: Hardness (HRA) | Cutting Characteristics (1) Amount of Plastic Deformation | Cutting Characteristics (2) $V_B$ | Cutting Characteristics (3) Damage Life (number) | Remarks |
|---|---|---|---|---|---|---|---|---|---|---|---|---|---|---|---|---|---|
| 21 | (40) | (60) | 40 | 85 | 8 | — | 8 | 7 | — | 7 | 1500 | 141 | 92.0 | 0.05 | 0.07 | more than 15 | WC/$MO_2C$ near Sample No. 5 |
| 22 | 24 (60) | 36 (40) | " | " | " | — | " | " | — | " | - | 140 | 92.1 | 0.04 | 0.07 | " | WC/$MO_2C$ near Sample No. 6 |
| 23 | 36 (35) | 24 (65) | " | " | " | — | " | " | — | " | " | 140 | 92.0 | 0.06 | 0.08 | " | WC/$MO_2C$ on line AB |
| 24 | 21 (65) | 39 (35) | " | " | " | — | " | " | — | " | " | 135 | 92.3 | 0.04 | 0.07 | 15 | WC/$MO_2C$ on line CD |
| 25 (30) | 39 (70) | 21 | " | " | " | — | " | " | — | " | " | 81 | 90.9 | chipping | chipping | 3 | WC/$MO_2C$ outside the range |
| 26 | 18 (70) | 42 (30) | " | " | " | — | " | " | — | " | " | 74 | 92.0 | " | " | 1 | WC/$MO_2C$ outside the range |

As shown by the results in Table 2, Samples Nos. 21 to 24 having a $WC/Mo_2C$ ratio within a range of 35:65 to 65:35 had low deflective strength and markedly deteriorated cutting characteristics and were therefore not feasible for practical purposes.

EXAMPLE 3

Samples were produced in the same manner as set forth previously except that the ratio of WC, $Mo_2C$ and TiC in the carbide was set at 30:30:40 which was, just as in Sample No. 1, approximately at the center of the tetragonal region A, B, C and D of FIG. 1, and the proportions of the carbide, nitride and binder metal were varied. The various proporties of the samples were determined, and the results obtained are shown in Table 3 below.

TABLE 3

| Sample No. | Carbide: $MO_2C$ / WC $MO_2C/WC$ $=35/65-65-35$ $WC+MO_2C=50-75$ | Carbide: Tic 25–50 | Carbide in the Entire Composition 60–92 | Nitride: TiN | Nitride: TaN | Nitride: Total 3–20 | Binder Metal: Ni | Binder Metal: Co | Binder Metal: Total 5–20 | Sintering Temperature (° C) | Characteristic Value: Deflective Strength (kg/cm²) | Characteristic Value: Hardness (HRA) | Cutting Characteristics (1) Amount of Plastic Deformation | Cutting Characteristics (2) $V_B$ | Cutting Characteristics (3) Damage life (number) | Remarks |
|---|---|---|---|---|---|---|---|---|---|---|---|---|---|---|---|---|
| 1 | 30 | 40 | 85 | 8 | — | 8 | 7 | — | 7 | 1500 | 140 | 92.1 | 0.04 | 0.07 | more than 15 | transferred from Table 1 |
| 31 | " | " | 60 | 10 | 10 | 20 | 10 | 10 | 20 | 1450 | 160 | 91.8 | 0.07 | 0.12 | " | |
| 32 | " | " | 92 | 2 | 1 | 3 | 3 | 2 | 5 | 1500 | 131 | 92.4 | 0.04 | 0.05 | 15 | |
| 33 | " | " | 56 | 12 | 10 | 22 | 12 | 10 | 22 | 1450 | 122 | 89.2 | 0.14 | 0.36 | more than 15 | Outside the range |
| 34 | " | " | 96 | 2 | — | 2 | 2 | — | 2 | 1550 | 95 | 89.0 | chipping | chipping | 1 | " |

As shown by the results in Table 3, Sample No. 31 in which the total amount of the carbide composed of $Mo_2C$, WC and TiC in a ratio of 30:30:40 was set at 60%, the lower limit, and the amounts of the nitride and the binder metal were set both at 20%, the upper limit, and Sample No. 32 in which the total amount of the carbide was set at 92%, the upper limit, and the amounts of the nitride and the binder metal were adjusted respectively to 3% and 5%, the lower limits, had almost the same characteristic values as Sample No. 1 in which the total amount of the carbide and the amounts of the nitride and the binder metal were set at values midway between the limits. However, Sample No. 33 in which the total amount of the carbide was below the lower limit, and the amounts of the nitride and the binder metal both exceeded the upper limits had a large amount of plastic deformation and large $V_B$ values and were unsuitable for practical applications. Furthermore, it was confirmed that Sample No. 34 in which the total amount of the carbide exceeded the upper limit and the amounts of nitride and the binder metal were below the lower limits caused chipping in a cutting test, and became useless for practical purposes.

Of Samples Nos. 33 and 34 which were outside the scope of the invention, the cutting characteristics of Sample No. 33 were equivalent to those of Sample A which was considered as best among the commercially available samples shown for comparison in Table 1.

EXAMPLE 4

In the same manner as in Example 3, the ratio of WC, $Mo_2C$ and TiC in the carbide was fixed at 30:30:40. The amount of the binder metal was fixed at 12% which was about the center of the range of 3 to 20%, and the content of the nitride in the entire composition was set at a point near the critical value. The characteristic values of the resulting samples were measured, and the results obtained are shown in Table 4 below.

TABLE 4

| Sample No. | Carbide: $MO_2C$/WC = 35/65-65-35 WC+$MO_2C$=50-75 | Carbide: TiC 25-50 | Carbide in the Entire Composition 60-92 | Nitride: TiN | Nitride: TaN | Nitride: Total 3-20 | Binder Metal: Ni | Binder Metal: Co | Binder Metal: Total 5-20 | Sintering Temperature (°C) | Characteristic Value: Grain Size of the Hard Phase (mic.) | Characteristic Value: Deflective Strength (kg/cm²) | Characteristic Value: Hardness (HRA) | Cutting Characteristics (1) Amount of Plastic Deformation | Cutting Characteristics (2) $V_B$ | Cutting Characteristics (3) Damage Life (number) | Remarks |
|---|---|---|---|---|---|---|---|---|---|---|---|---|---|---|---|---|---|
| 41 | 30 | 40 | 85 | 1 | 2 | 3 | 6 | 6 | 12 | 1180 | 1.2 | 141 | 92.1 | 0.06 | 0.08 | 15 | |
| 42 | " | " | 68 | 10 | 10 | 20 | " | " | " | " | 0.9 | 145 | 91.9 | 0.07 | 0.08 | more than 15 | |
| 43 | " | " | 87 | 1 | — | 1 | " | " | " | " | 2.9 | 125 | 91.0 | 0.08 | chipping | 2 | Outside the range |
| 44 | " | " | 67 | 22 | — | 22 | " | " | " | " | 1.6 | 128 | 88.9 | chipping | " | 1 | " |
| 45 | " | " | 88 | — | — | — | " | " | " | " | 3.3 | 119 | 87.3 | " | " | 1 | " |

As shown by the results in Table 4, when the amount of the binder metal was set at 12%, the amount of the nitride was adjusted to a point near the critical value, and the remainder was a carbide composed of $Mo_2C$, WC and TiC in a ratio of 30:30:40, Samples Nos. 41 and 42 in which the amount of the nitride was set at 3%, the lower limit, and 20%, the upper limit, showed satisfactory characteristics, but Samples Nos. 43 and 44 in which the amount of the nitride was below the lower limit, or above the upper limit, respectively, both had markedly deteriorated cutting characteristics, and could not withstand practical use.

Sample No. 45 in which the amount of binder metal was set at 12%, and no nitride was blended but the amount of the carbide was increased to make up for the lack of nitride exhibited characteristics which were deteriorated to a greater extent than those of Sample No. 43 in which the amount of the nitride was 1%. Thus the addition of a tiny amount of nitride was clearly demonstrated to inhibit the grain growth of a hard phase of sintered alloy, but in order to improve the cutting characteristics of the sintered alloy, amounts of 3 to 20% were required.

EXAMPLE 5

Samples were produced in the same manner as in Example 4 except that the amount of the nitride was set at 10% which was approximately at the center of the specified range, and the amount of the binder metal was varied. The characteristics of the samples were determined, and the results obtained are shown in Table 5 below.

TABLE 5

| Sample No. | Carbide: $MO_2C$ | Carbide: WC | Carbide: TiC | Carbide in the Entire Composition | Nitride: TiN | Nitride: TaN | Nitride: Total 3–20 | Binder Metal: Ni | Binder Metal: Co | Binder Metal: Total 5–20 | Sintering Temperature (°C) | Characteristic Value: Deflective Strength (kg/cm²) | Characteristic Value: Amount of Hardness (HRA) | Cutting Characteristics (1): Plastic Deformation | Cutting Characteristics (2): $V_B$ | Cutting Characteristics (3): Damage Life (number) | Remarks |
|---|---|---|---|---|---|---|---|---|---|---|---|---|---|---|---|---|---|
| | $MO_2C/WC$ =35/65–65/35 | | | | | | | | | | | | | | | | |
| | $WC+MO_2C$=50–75 | | 25–50 | 60–92 | | | 3–20 | | | 5–20 | | | | | | | |
| 51 | 30 | 30 | 40 | 85 | 5 | 5 | 10 | 3 | 2 | 5 | 1550 | 131 | 92.2 | 0.04 | 0.05 | 15 | |
| 52 | " | " | " | 70 | " | " | " | 10 | 10 | 20 | 1450 | 158 | 91.9 | 0.07 | 0.10 | more than 15 | |
| 53 | " | " | " | 87 | " | " | " | 2 | 1 | 3 | 1550 | 102 | 92.0 | chipping | chipping | 1 | Outside the range |
| 54 | " | " | " | 68 | " | " | " | 12 | 10 | 22 | 1450 | 126 | 89.7 | 0.11 | 0.40 | more than 15 | |

As shown by the results in Table 5 when the amount of the nitride was set at 10%, the amount of the binder was adjusted to a point near the critical value, and the remainder was carbide, Samples Nos. 51 and 52 in which the amount of the binder metal was 5%, the lower limit, and 20%, the upper limit, respectively, showed superior properties, but Sample No. 53 in which the amount of the binder metal was below the lower limit caused chipping in the cutting test and could not withstand use, and Sample No. 54 in which the amount of the binder metal exceeded the upper limit had a large amount of plastic deformation, which $V_B$ and poor feasibility.

As illustrated hereinabove, the sintered alloy for cutting tools in accordance with this invention which comprises 60 to 92% by weight of a carbide composed of $Mo_2C$, WC and TiC in proportions shown by the tetragonal region surrounded by points A, B, C and D in the ternary composition diagram of FIG. 1, the proportion of the sum of WC and $Mo_2C$ with WC/$Mo_2C$ weight ratio of 35:65 to 65:35 being 50 to 75% by weight, and the proportion of TiC being 25 to 50% by weight, 3 to 20% by weight of a nitride which is either TiN, TaN or a mixture of TiN and TaN, and 5 to 20% by weight of Ni or Co or a mixture of Ni and Co as a binder metal has a extremely fine crystal grain size, and far superior cutting characteristics.

Sample A considered to be best among the commercially available sintered alloys only showed equivalent cutting properties to Samples Nos. 33 and 54 which are outside the scope of the invention, and this substantiates the superior characteristics of the alloys of this invention.

Figure 2:
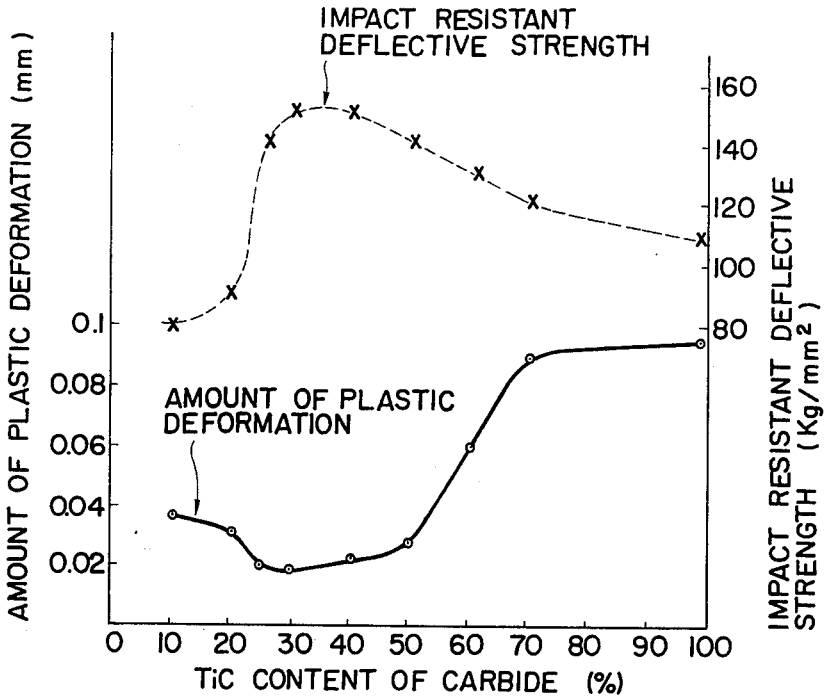
FIG. 2 is a diagram showing the effect of the TiC content of the carbide on the amount of plastic deformation and impact resistant deflective strength of the sintered alloy.

The reason for limiting the amount of TiC in the entire carbide to 25 to 50% by weight is firstly that Samples Nos. 19, 14, 20, 17, 13 and 18 outside the region A, B, C and D have the characteristic values shown in Table 1. In addition, as shown in FIG. 2 which shows the relationship of the TiC content in the carbide in a sintered alloy comprising 85% by weight of the carbide, 5% by weight of TiN and 10% by weight of Ni on a line connecting points (sample Nos.) 3 and 4 in FIG. 1 to the impact strength of this sintered alloy which was measured by supporting a test sample (4 × 8 × 25 mm) (the same as that used in measuring the amount of plastic deformation and deflective strength in Cutting Characteristic (1) set forth hereinabove) with a span of 20 mm, and letting a 300 g steel ball fall thereon instead of a stationary load, coarse acicular crystals of $Mo_2C$ and WC are formed if the amount of TiC does not reach 25% by weight of the entire carbide. Hence, the deflective strength of the sintered alloy is reduced abruptly. On the other hand, when the amount of TiC exceeds 50% by weight, the amount of plastic deformation increases markedly.

Figure 3:
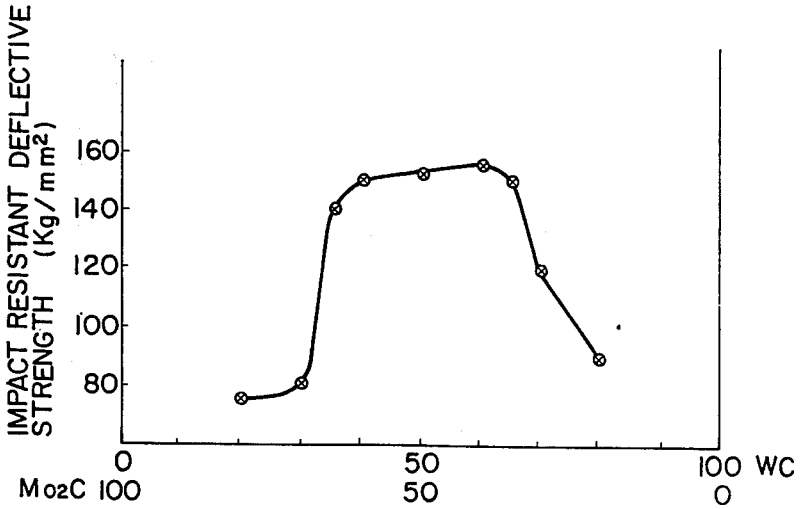
FIG. 3 is a diagram showing the effect of the ratio of WC/$Mo_2C$ in the carbide on the impact resistant deflective strength of the sintered alloy.

The reason for limiting the WC/$Mo_2C$ ratio in the carbide to 35:65 to 65:35 is that when the amount of WC is less than 35% by weight, the amount of $Mo_2C$ becomes excessive causing a precipitation of brittle $Mo_2C$ crystals, and on the other hand, when the amount of WC exceeds 65% by weight, coarse acicular WC crystals are precipitated. In both cases, the sintered alloy becomes brittle, and as shown in Table 2, its cutting characteristics are deteriorated. Furthermore, in order to investigate impact resistant deflective strength, a test was conducted in which a 300 g steel ball was dropped thereon instead of a stationary load onto samples of 85% by weight of a carbide wih a WC + $Mo_2C$/TiC ratio of 60:40, 8% by weight of NiN and 7% by weight of Ni with varying ratios between WC and $Mo_2C$ (the sum of WC and $Mo_2C$ in the entire carbide being 60% by weight). The samples showed deflective strengths of the same tendency as shown in Table 2, as is seen from FIG. 3.

The reason for limiting the content of the nitride TiN and/or TaN to 3 to 20% by weight is that as shown in Table 4, when the amount is less than 3% by weight, the effect of inhibiting grain growth is poor, and when the amount exceeds 20% by weight, pores occur. In either case, the cutting characteristics of the resulting sintered alloys are markdly deteriorated, and the alloys cannot be employed practically.

The reason for limiting the amount of the binder metal Ni and/or Co to 5 to 20% by weight is that as shown in FIG. 5, when the amount is less than 5% by weight, the resulting alloys have poor toughness and cause chipping, and when the amount exceeds 20% by weight, the resulting alloys have insufficient hardness, and therefore, reduced abrasion resistance.

As stated hereinabove, the incorporation of the nitride TiN and/or TaN is to inhibit the grain growth of sintered alloys, and its effect is demonstrated by Sample No. 45 in Table 4 which did not contain the nitride. TiN is slightly better than TaN in solubility, but this difference is barely appreciable.

In each of the above examples, the main ingredient carbide composed of $Mo_2C$, WC and TiC was used in the mixed state, but it is desirable that they be made into triple carbide by dissolving them in a customary manner to form a solid solution.

While the invention has been described in detail and with reference to specific embodiments thereof, it will be apparent to one skilled in the art that various changes and modifications can be made therein without departing from the spirit and scope thereof.

What is claimed is:

1. A sintered alloy for cutting tools consisting essentially of 60 to 92% by weight of a carbide comprising $Mo_2C$, WC and TiC in the proportions shown by the tetragonal region A, B, C and D in the ternary composition diagram of FIG. 1, the proportion of the sum of WC and $Mo_2C$ with a WC/$Mo_2C$ weight ratio of 35:65 to 65:35 being 50 to 75% by weight, and the proportion of TiC being 25 to 50% by weight;

3 to 20% by weight of a nitride selected from the group consisting of TiN, TaN or a mixture of TiN and TaN; and 5 to 20% by weight of Ni, Co or a mixture of Ni and Co as a binder metal; and wherein the carbide and nitride are in the form of a solid solution phase nitride with a grain size of not more than 1.3 $\mu$ and a binder metal phase.

* * * * *